US011447296B2

(12) United States Patent
DiCarlo

(10) Patent No.: US 11,447,296 B2
(45) Date of Patent: Sep. 20, 2022

(54) APPARATUS FOR POURING WINE

(71) Applicant: Tom DiCarlo, Arlington Hts, IL (US)

(72) Inventor: Tom DiCarlo, Arlington Hts, IL (US)

( * ) Notice: Subject to any disclaimer, the term of this patent is extended or adjusted under 35 U.S.C. 154(b) by 358 days.

(21) Appl. No.: 16/836,371

(22) Filed: Mar. 31, 2020

(65) Prior Publication Data

US 2020/0223587 A1 Jul. 16, 2020

Related U.S. Application Data

(60) Provisional application No. 62/920,042, filed on Apr. 11, 2019.

(51) Int. Cl.
*B65D 23/10* (2006.01)

(52) U.S. Cl.
CPC ..... *B65D 23/104* (2013.01)

(58) Field of Classification Search
CPC ... A47G 23/0241; A47G 23/02; B65D 23/104
USPC ..... 215/395; 222/180
See application file for complete search history.

(56) References Cited

U.S. PATENT DOCUMENTS 2,300,745 A * 11/1942 Jenkins ..... A47G 23/0241 215/396
2,991,907 A * 7/1961 Kinnison ..... A47G 23/0216 215/396
3,202,309 A * 8/1965 Simpson ..... A47G 23/0241 215/396
4,836,476 A * 6/1989 Wolf ..... A47G 23/0241 362/802

* cited by examiner

*Primary Examiner* — Stephen J Castellano
(74) *Attorney, Agent, or Firm* — Barry Choobin; Patent 360

(57) ABSTRACT

The present invention is directed to an apparatus for holding and pouring wine from a wine bottle. The apparatus comprises a body strap with a ring at one end of the body strap. The other end of the body strap passes through the ring forming a loop. The apparatus further comprises a base strap configured to fit around the body of the bottle. The base strap coupled to a thumb ring through a hook. The other open end of the body strap coupled to the thumb ring.

9 Claims, 3 Drawing Sheets

APPARATUS FOR POURING WINE

CROSS-REFERENCE TO RELATED APPLICATIONS

This application claims priority to the U.S. provisional patent application Ser. No. 62/920,042 filed Apr. 11, 2019, which is incorporated herein by reference in its entirety.

FIELD OF INVENTION

The present invention is related to an apparatus for dispensing bottled beverages, and in more particularly relates to an apparatus for pouring wine from a wine bottle.

BACKGROUND

The pouring of the wine is part of the overall experience of the wine service. Wine is a peculiar beverage and the wine enthusiasts are always particular about how the wine bottle is opened, poured and served. It has been agreed among majority of the wine enthusiasts that the way a wine bottle is opened and poured may perceptibly affect the taste of the wine. Moreover, change in the temperature of the wine during handing can also somewhat affect the taste of the wine. This is the reason, servers often wrap a napkin around the bottle so that the warmth of their hand could not affect the temperature of the wine. Wine enthusiasts always appreciate the extra effort put forth to ensure the perfect serving conditions of wine.

Wines are generally available in heavy glass bottles of about 25 ounces capacity. To pour the wine in a glass, the wine bottle is generally grasped from the bottom by the hand and bringing the neck of the wine bottle towards the glass without touching it and making sure that the wine pours smoothly. Another known technique for pouring the wine is by cradling the bottom of the wine bottle indentation called the "punt". These methods of pouring the wine give a more elegant pour presentation, however, such methods also create a significant strain on the server's wrist, especially the hand on repetitive pours. A server may also suffer from chronic injury over a long period.

Thus, a need is appreciated for an apparatus for handing and elegantly pouring wine from a wine bottle without straining the hands of the server.

SUMMARY OF THE INVENTION

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The principal objective of the present invention is therefore directed to an apparatus for handling and pouring wine from a wine bottle.

It is another objective of the present invention that the apparatus prevents any strain or injury to the server.

It is still another objective of the present invention that the apparatus allows elegantly pouring the wine.

It is a further objective of the present invention that the apparatus circumvents the need for a napkin wrapped around the bottle by keeping a distance between the hand of the server and the wine bottle.

It is still further objective of the present invention that the apparatus provides for holding the closure of the bottle while the wine is being poured.

It is yet a further objective of the present invention that the apparatus is economic to manufacture and easy to use.

In one aspect, the present invention is directed to an apparatus for holding and pouring wine from a wine bottle. The apparatus comprises a body strap with a ring at one end of the body strap. The other end of the body strap passes through the ring forming a loop. The apparatus further comprises a base strap configured to fit around the body of a bottle. The base strap coupled to a thumb ring through a hook. The body strap can also be coupled to the thumb ring.

In one aspect, the body strap can have means to adjust the length of the body strap. The means for adjusting the length of the body strap can include a buckle or a slider. The body strap loops through these length adjusting mean to adjust the length of the body strap according to the height of the bottle.

In one aspect, the base strap can be adjusted in length to snugly fit around the bottle. For example, the base strap could be provided as a cylindrical body made of elastic material that is stretched according to different sized bottles. Alternatively, the base strap can have free ends along its length that can be configured with fasteners, such as hook and loop fastener. The free ends of the base strap can mate to form the cylindrical body. The fastener provides for adjusting the diameter of the cylindrical body according to the girth of the bottle.

In one aspect, the apparatus further comprises a magnet coupled to the base strap. The magnet configured to hold the thumb ring when not in use.

In one aspect, the apparatus further comprises a cork rest slidably configured along the body strap.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
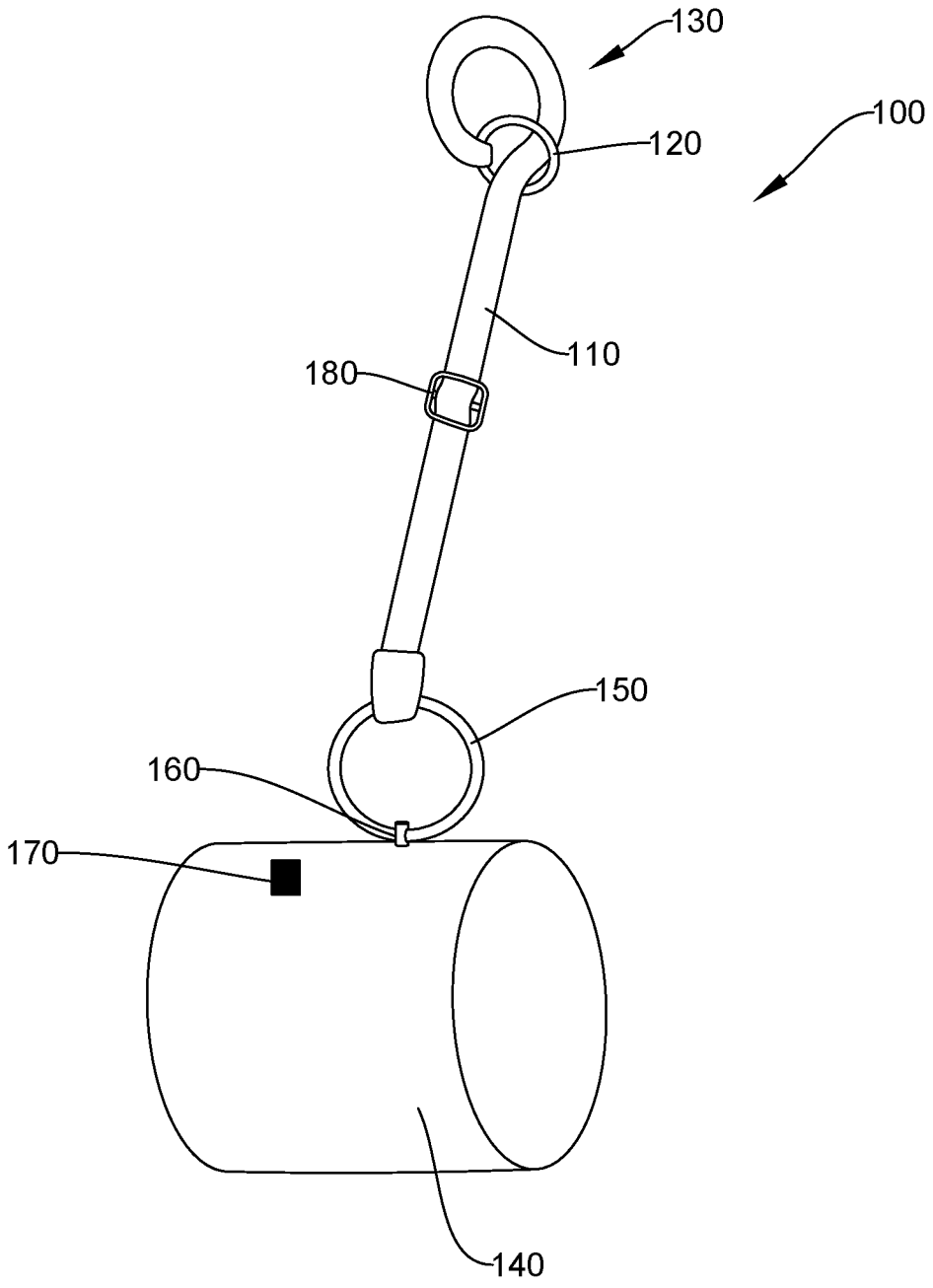
FIG. 1 illustrates an apparatus for handing and pouring wine from a wine bottle, according to an embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

The present invention is directed to an apparatus for handing different sized wine bottles and elegantly pouring wine from the wine bottle without straining the hands of the server. As shown in FIG. 1, the apparatus 100 includes a body strap 110 having a first end and an opposite second end. The body strap 110 shown in FIG. 1 is a polyester-based strap having a pre-determined width. FIG. 1 shows a strap, however, slings, cords and like are within the scope of the present invention. The length of the body strap 110 could be adjusted according to the height of the bottle, to which apparatus is being applied. To allow the same apparatus 100 applied to bottles of different heights, the body strap 110 can be configured with a length adjustment means. FIG. 1 shows a length adjustment slider 180, wherein the body strap 110 loops through the slider 180. The working and functioning of the length adjusting sliders for adjusting the length of straps are known to a skilled person. Alternatively, a buckle can also be used. The buckle can be in the form of a rigid loop of plastic or metal that interrupts the length of the body strap 110 into two-part straps. The first part strap can be coupled to the bucked, while the other part strap can loop through the buckle and couple along its length. For example, the end of the part strap can be configured with a fastener. Which loop through the buckle and the free end of the part strap mate to the side surface of the part strap. The fastener can be a hook and loop fastener, such as Velcro. The working and functioning of the buckles for adjusting the length of a strap are known to a skilled person. Also, any other means to adjust the length of a strap, known to a skilled person can be embodied in the present invention without departing from the scope of the invention.

The first end of the body strap 110 is coupled to a ring 120. The ring as shown in FIG. 1 is a round shape ring, however, rings of alternates shapes including D-ring and square shape rings are within the scope of the present invention. The second end of the body strap 110 passes through the ring 120 to form a loop 130. The loop 130 can slip into the neck of the bottle and clinch around the neck near the shoulder of the bottle. Furthermore, it can be seen in FIG. 1 is a base strap 140 in the form of a cylindrical body. The base strap 140 can be wrapped around the body of the bottle. The base strap 140 can resemble an elastic band for snuggly fitting around the body of the bottle. The base strap 140 can be made of neoprene mixed with spandex in a ratio to provide the desired elasticity. The elasticity can be crucial to allow the base strap 140 to fit around bottles of various sizes and girths. Alternatively, the base strap 140 can have free ends along its length, wherein the free ends can mate to form the cylindrical body. The free ends of the base strap could be configured with a fastener, such as a hook and loop fastener for adjusting the length of the base strap 140.

The base strap 140 can be coupled to a thumb ring 150 through a hook 150. The hook 160 can be a D-ring coupled to the base strap 140. The hook 160 permits pivotal movement of the thumb ring 150 against the hook 160. The hook 160 can be made of any rigid material including plastics and metals. The second end of the body strap 110 is coupled to the thumb ring 150. The thumb ring 150 is can be configured to receive the thumb of a hand, while the hand is holding the bottle from the base. The thumb ring 150 can be made of any rigid material, such as plastic or metal. Further shown in FIG. 1 is a magnet 170 coupled to the base strap 140. To the magnet 170 can be attached the thumb ring 150 when not in use.

Figure 2:
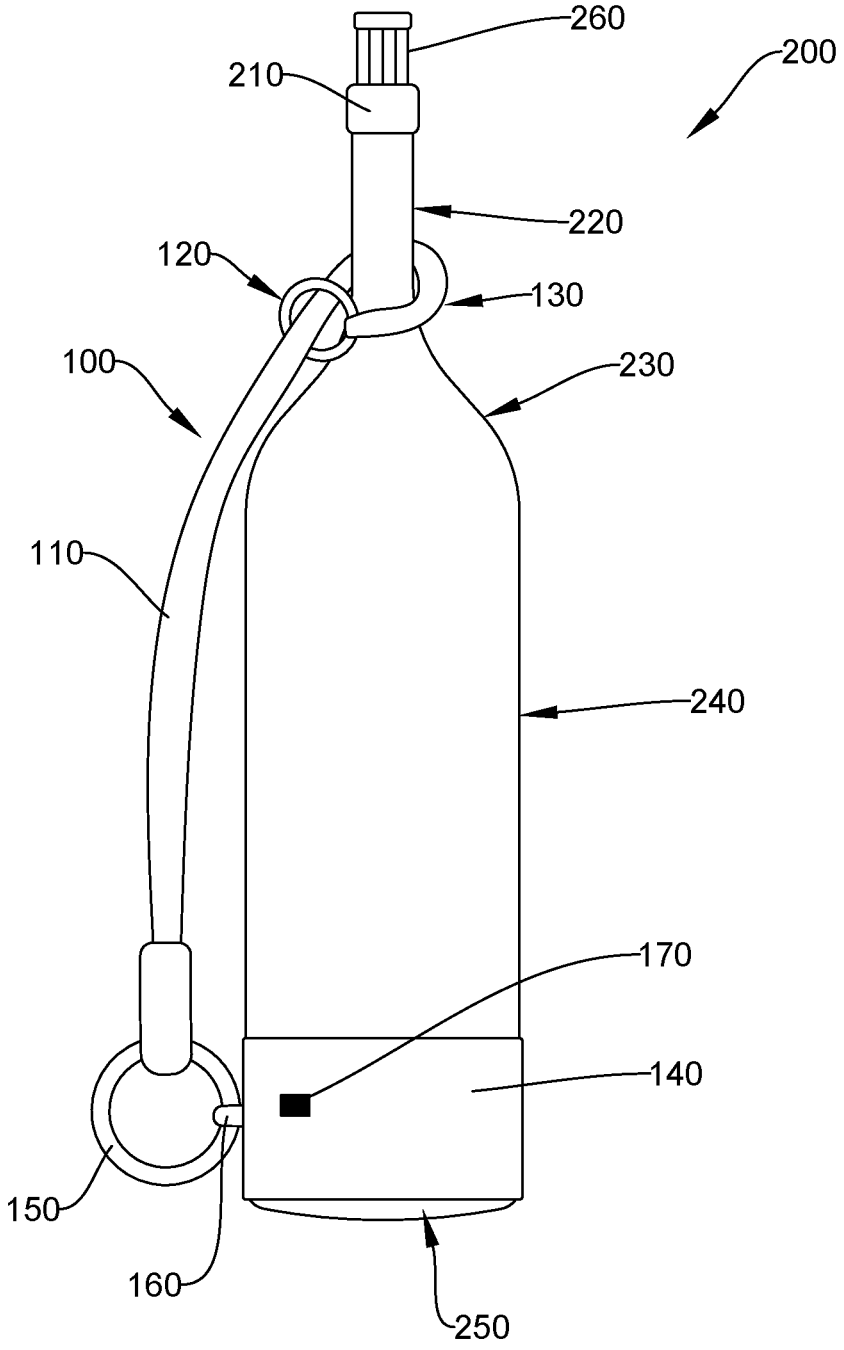
FIG. 2 shows the apparatus of FIG. 1, applied to a bottle, according to an embodiment of the present invention.

FIG. 2 shows the apparatus 100 applied to a bottle 200. The bottle 200 having a mouth 210, a neck 220, a shoulder 230, a body 240 and a base 250. The base strap 140 of the apparatus 100 is wrapped around the lower body portion 240 of the bottle 200. The loop 130 can be seen clinched around the neck 220 of the bottle 200, while the body strap 110 extends up to the thumb ring 150. A cork 260 closes the mouth 210 of the bottle 200. The apparatus 100 through the body strap 110 can be used to handle and transport the bottle 200. The base strap 110 at its middle portion can be grasped by a hand to lift the bottle 200.

In one embodiment, the apparatus 100 can be mounted to a bottle 200 by first slipping the base strap 140 through the mouth 210 of the bottle to the lower portion of the body 240 of the bottle 200. Thereafter, the loop 130 can be slipped through the mouth 210 of the bottle and clinched around the neck 220 of the bottle 200.

Figure 3:
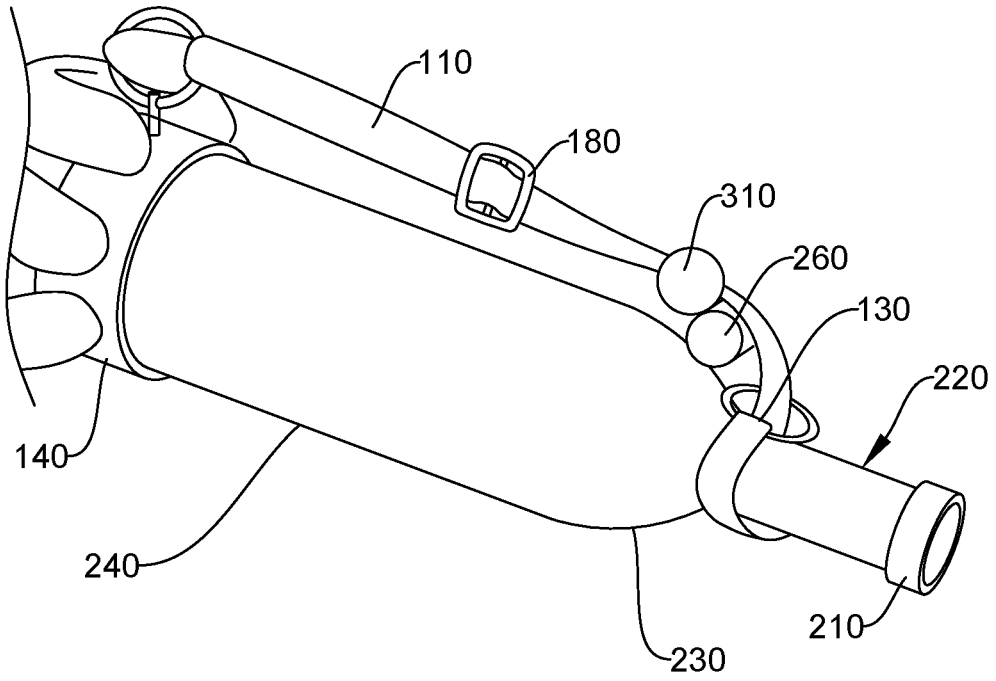
FIG. 3 shows an embodiment of pouring wine using the apparatus of FIG. 1.

FIG. 3 illustrate the application of the apparatus 100 for pouring wine from the bottle 200. The bottle 200 with its cork 260 removed can be placed over the palm 300. The base 250 of the bottle 200 is placed over the palm 300. The bottle can then be grasped by the palm while the thumb of the hand slips into the thumb ring 150. Thereafter the cork 260 can be placed below the body strap 110 and adjusted to be supported against the neck 220 and shoulder 230 of the bottle 200. Furthermore, it can be seen in FIG. 3 a spherical shape cork rest 310 configured into the base strap 110 near the loop 130. The cork rest 310 can have an aperture throughout its diameter, wherein the body strap 110 can be slidably and snugly passed through the aperture. The cork rest 310 can be made of wood, ceramic, glass, plastic and like rigid material. It is shown in FIG. 3 the cork rest of spherical shape, however, cork rest of any other shapes are within the scope of the present invention. The cork rest 310 provides additional support and stability to the cork 260 held between the body strap 110 and the bottle 200. The cork 260 can be held by applying tension to the body strap 110 through the thumb inserted into the thumb ring 150. Extending the thumb causes the body strap 110 to taunt over the cork 260 which acts as a fulcrum and the body strap 110 supports the neck 220 of the bottle 200. To pour the wine from the bottle 200, the bottle 200 can be tilted such as the thumb ring 150 faces upwards. Slowly the bottle 200 can be further tilted to smoothly pour wine, while the weight of the bottle can be evenly distributed onto the palm through the apparatus 100, thus, reducing the strain on the server's wrist, hand, and fingers.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An apparatus for pouring a beverage from a bottle, the apparatus comprising:

a body strap having a first end and a second end;

a ring coupled to the first end of the body strap and the second end passes through the ring to form a loop;

a base strap configured to fit around the body of the bottle; and a thumb ring configured to receive a thumb of a hand, the thumb ring coupled to the base strap through a hook, the thumb ring coupled to the second end of the body strap.

2. The apparatus of claim 1, wherein the apparatus further comprises a length adjusting means configured to the body strap for adjusting the length of the body strap.

3. The apparatus of claim 2, wherein the length adjusting means is a buckle or a length adjusting slider.

4. The apparatus of claim 1, wherein the bottle is a wine bottle of a capacity of 25 ounces.

5. The apparatus of claim 1, wherein the apparatus further comprises a magnet coupled to the base strap.

6. The apparatus of claim 1, wherein the apparatus further comprises a cork rest slidably configured along the body strap.

7. The apparatus of claim 6, wherein the cork rest is having an aperture extending throughout its diameter and the body strap snugly passes through the aperture.

8. The apparatus of claim 1, wherein the base strap is provided as a cylindrical body made of elastic material.

9. The apparatus of claim 1, wherein the base strap is having opposite free ends which mates to form a cylindrical body, wherein the free ends configured with a hook and loop fastener for adjusting the size of the cylindrical body.

* * * * *